US006170103B1

(12) United States Patent
Wang et al.

(10) Patent No.: US 6,170,103 B1
(45) Date of Patent: Jan. 9, 2001

(54) MULTI-SUPPORT SLEEPING PILLOWS

(76) Inventors: Rong-Shuang Wang, 609 Shikes Way, Egg Harbor Township, NJ (US) 08234; Rong-Ine Ma, 8708 Marshall Rd., Wyndmoor, PA (US) 19038

( * ) Notice: Under 35 U.S.C. 154(b), the term of this patent shall be extended for 0 days.

(21) Appl. No.: 09/223,137

(22) Filed: Dec. 30, 1998

(51) Int. Cl.[7] ..... A47G 9/00
(52) U.S. Cl. ..... 5/636; 5/645
(58) Field of Search ..... 5/636, 640, 645, 5/490

(56) References Cited

U.S. PATENT DOCUMENTS

| | | | | |
|---|---|---|---|---|
| 1,447,288 | * | 3/1923 | Emmerich | 5/645 |
| 2,013,481 | * | 9/1935 | Stonehill | 5/640 |
| 2,556,629 | * | 6/1951 | O'Brien | 5/640 X |
| 2,765,480 | * | 10/1956 | Mueller | 5/636 X |
| 2,952,856 | * | 9/1960 | Ruff | 5/640 |
| 3,900,910 | * | 8/1975 | Nakata | 5/636 X |
| 4,274,673 | * | 6/1981 | Kifferstein | 5/640 X |
| 4,345,345 | * | 8/1982 | Holtz | 5/640 |
| 4,345,346 | * | 8/1982 | Holtz | 5/640 |
| 4,776,049 | * | 10/1988 | Perron | 5/640 |
| 4,908,894 | * | 3/1990 | Sanders | 5/640 |
| 5,088,141 | * | 2/1992 | Meyer et al. | 5/636 X |
| 5,193,238 | * | 3/1993 | Clute | 5/490 X |
| 5,363,524 | * | 11/1994 | Lang | 5/640 |
| 5,367,731 | * | 11/1994 | O'Sullivan | 5/636 X |
| 5,708,998 | * | 1/1998 | Torbik | 5/636 |
| 5,864,904 | * | 2/1999 | Rudick | 5/636 X |

FOREIGN PATENT DOCUMENTS

| | | | | |
|---|---|---|---|---|
| 2452899 | * | 5/1976 | (DE) | 5/636 |
| 1137868 | * | 6/1957 | (FR) | 5/640 |
| 14561 | * | 11/1913 | (GB) | 5/640 |
| 2026315 | * | 2/1980 | (GB) | 5/645 |

* cited by examiner

*Primary Examiner*—Terry Lee Melius
*Assistant Examiner*—Robert G. Santos

(57) ABSTRACT

Traditional rectangular sleeping pillows with filling are improved. There are several pillow configurations in this invention. Each configuration has two heights available for its user to choose. The user can also make choice of the neck support or not. The arrangement of the two heights also allows the user to easily get proper supports for two sleeping postures, i.e. shoulder vertical and shoulder horizontal. Portion of the pillow contour gives comfortable and secure feeling like baby sleeps on mother's breast. All the configurations can use existing pillowcase in the market.

4 Claims, 3 Drawing Sheets

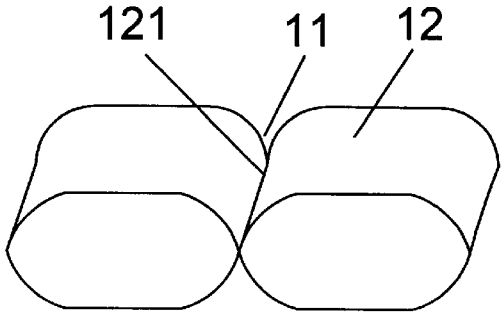
FIG. 1.1
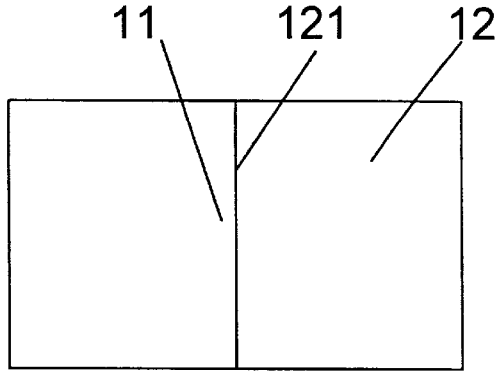
FIG. 1.2
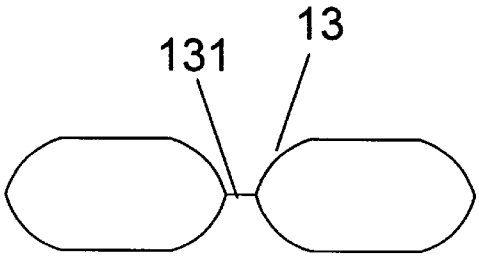
FIG. 2.1
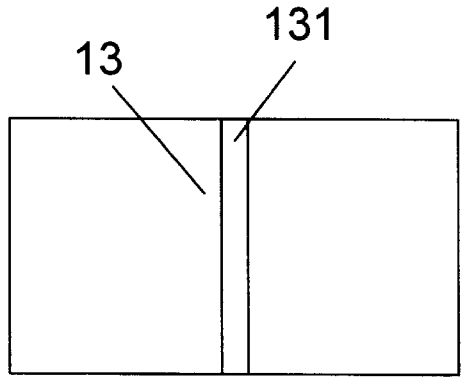
FIG. 2.2
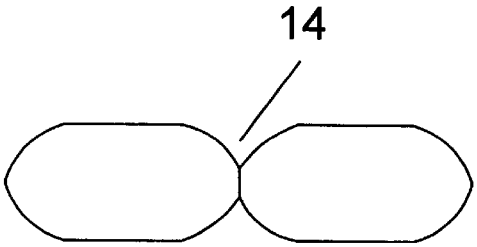
FIG. 3.1
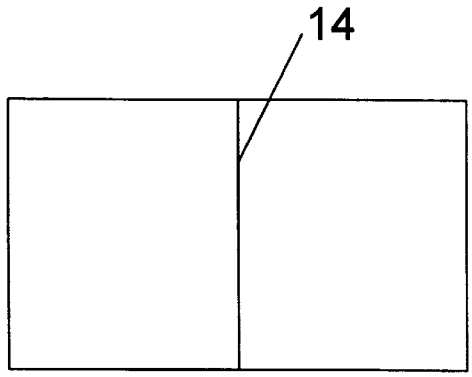
FIG. 3.2

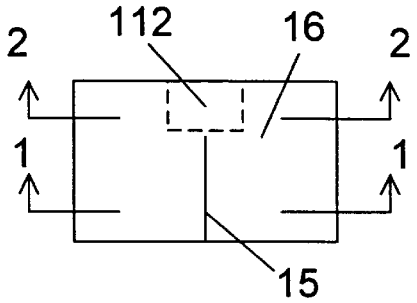
FIG. 4.1
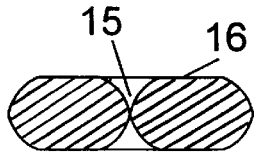
FIG. 4.2 1-1
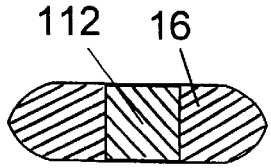
FIG. 4.3 2-2
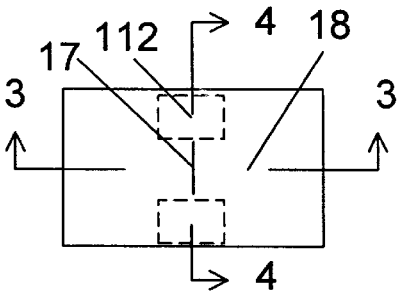
FIG. 5.1
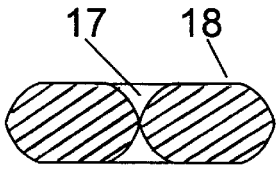
FIG. 5.2 3-3
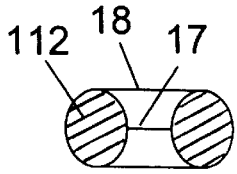
FIG. 5.3 4-4
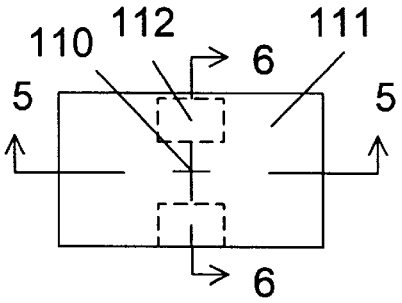
FIG. 6.1
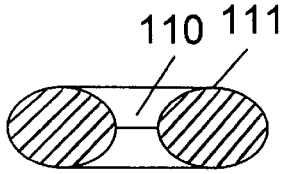
FIG. 6.2 5-5
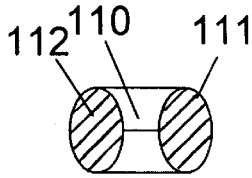
FIG. 6.3 6-6

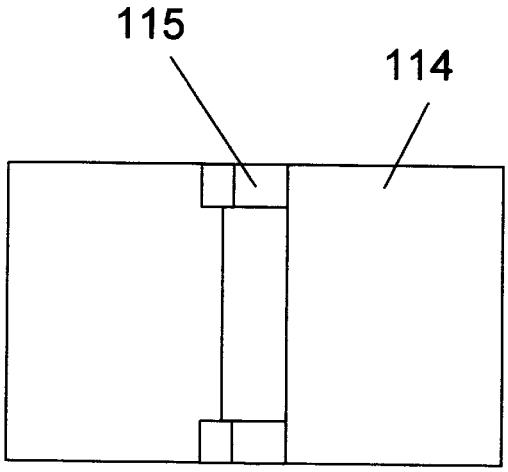
FIG. 7.1
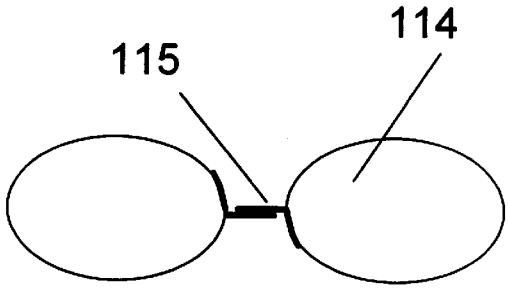
FIG. 7.2

MULTI-SUPPORT SLEEPING PILLOWS

FIELD OF INVENTION

The present invention relates to improvement of traditional sleeping pillows.

BACKGROUND OF THE INVENTION

A traditional sleeping pillow having a rectangular sealed bag with loose filling basically has only one height. The height may vary from pillow to pillow. The pillows are used in hotel and at home. Hotel pillows have been a problem for travelers. The pillows may be either too high or too low, and a traveler just cannot do anything if his pillow is too high. The pillows at home are not ideal either. They may be a little bit too high for shoulder horizontal sleeping posture and a little bit too low for shoulder vertical posture. It is also known that some people need neck support and some don't. A traditional pillow is simply not very flexible in satisfying the different needs. There are special pillows. However, they have different configurations, are not as acceptable as the traditional pillows, and some do not fit in the traditional pillowcase. With minimum change from traditional pillow, this invention is to solve all these problems.

OBJECTIVES OF THE INVENTION

The primary objective of this invention is to improve traditional pillows such that they allow the user to easily choose, during sleep or not during sleep, to rest his head on a more comfortable height.

Another objective of this invention is to improve traditional pillows such that they allow the user to have the choice of various neck supports.

Yet another objective of this invention is to provide improved traditional pillows which can use traditional pillowcase in the market.

BRIEF DESCRIPTION OF THE DRAWINGS

FIG. 1.1 shows the front perspective view of a configuration of this invention.

FIG. 1.2 is the top view of the configuration shown in FIG. 1.1.

FIG. 2.1 is the front view of a variation of the configuration shown in FIG. 1.

FIG. 2.2 is the top view of the configuration shown in FIG. 2.1.

FIG. 3.1 is the front view of another variation of the configuration shown in FIG. 1.

FIG. 3.2 is the top view of the configuration shown in FIG. 3.1.

FIG. 4.1 is the top view of another configuration of this invention.

FIG. 4.2 is the 1—1 cross section view of the configuration shown in FIG. 4.1

FIG. 4.3 is the 2—2 cross section view of the configuration shown in FIG. 4.1.

FIG. 5.1 is the top view of still another configuration of this invention.

FIG. 5.2 is the 3—3 cross section view of the configuration shown in FIG. 5.1.

FIG. 5.3 is the 4—4 cross section view of the configuration shown in FIG. 5.1.

FIG. 6.1 is the top view of yet another configuration of this invention.

FIG. 6.2 is the 5—5 cross section view of the configuration shown in FIG. 6.1.

FIG. 6.3 is the 6—6 cross section view of the configuration shown in FIG. 6.1.

FIG. 7.1 is the top view of yet still another configuration of this invention.

FIG. 7.2 is the front view of the configuration shown in FIG. 7.1.

DETAILED DESCRIPTION OF THE INVENTION

FIG. 1.1 shows the front perspective view of a configuration of this invention. The pillow has a basic construct of a traditional pillow, i.e. a rectangular sealed bag with loose filling of fibers, beans, herbs, feathers, or air, except the middle portion of the pillow has a lateral valley [11]. The valley [11] is formed by connecting the middle portion of the upper shell and the corresponding portion of the lower shell of the bag, e.g. by sewing them together. The bottom of the valley [11] is a line [121]. When the pillow is in use, the bottom of the valley [11] may be pressed down to the bed. On each side of the valley [11] is a plateau [12]. When the pillow is used in a hotel, the user can choose to rest his head in the valley [11] if he is accustomed to a lower pillow, or on the plateau [12] if he is accustomed to a higher pillow. During sleep or not, one can also conveniently use the valley [11] for the shoulder horizontal sleeping posture, and the plateau [12] for the shoulder vertical sleeping posture.

FIG. 1.2 is the top view of the configuration shown in FIG. 1.1.

FIG. 2.1 is the front view of a variation of the configuration shown in FIG. 1.1 and FIG. 1.2. It shows a broadened valley [13]. The bottom of the valley [13] is a strip [131]. With the valley [13], the pillow gives more room for one to turn his head in the valley [13] and provides more height difference between its plateau and valley when the pillow is in use. The strip [131] shown has a uniform width. However, a fan-out strip (not shown), i.e. the width at one end of the strip is narrower than that at the other end, provides additional effects. One may get a stretched feeling on his neck if the narrow end of the strip is closer to his shoulder, and a compressed feeling if the wider end is closer to his shoulder. These ideas of valley broadening are also applicable to other configurations of this invention.

FIG. 2.2 is the top view of the configuration shown in FIG. 2.1.

FIG. 3.1 is the front view of another variation of the configuration shown in FIG. 1. It shows a shallow valley [14], i.e. the upper and lower shells of the pillow are pulled close to but not touching each other. It is obvious that this idea of providing less pillow height difference between its plateau and valley is applicable to all other configurations of this invention.

FIG. 3.2 is the top view of the configuration shown in FIG. 3.1.

FIG. 4.1 is the top view of another configuration of this invention. It shows that a lateral valley [15] only runs through a portion of the pillow width. The rest of the pillow is a plateau [16]. In addition to the comforts that can be provided by the configuration shown in FIG. 1., this configuration can also provide neck support by the portion of the plateau [16] at the end of the valley [15]. One can get neck support by placing the portion under his neck and rest his head in the valley [15]. To have a firmer neck support, a block [112] of firmer material, like foam rubber or a small air bag with sigher air pressure, may be used for the filling in the portion of the plateau [16] at the end of the valley [15].

FIG. 4.2 is the 1–1 cross section view of the configuration shown in FIG. 4.1

FIG. 4.3 is the 2—2 cross section view of the configuration shown in FIG. 4.1.

FIG. 5.1 is the top view of still another configuration of this invention. A laterally elongated concavity [17] is in the middle portion of the pillow. The concavity [17] is surrounded by a plateau [18]. This configuration provides neck support by using the portion of plateau [18] at either end of the elongated concavity [17]. The elongated concavity [17] provides room between the top of one's head and the portion of the plateau [18] at the other end of the concavity [17] such that he would not feel an uncomfortable pressure caused by the portion of plateau [18] on the top of his head. Likewise, to have a firmer neck support, a block [112] of firmer material, like foam rubber or a small air bag with higher air pressure, may be used for the filling in the portion of the plateau [18] at each end of the concavity [17].

FIG. 5.2 is the 3—3 cross section view of the configuration shown in FIG. 5.1.

FIG. 5.3 is the 4—4 cross section view of the configuration shown in FIG. 5.1. This figure shows that the bottom of the concavity [17] does not contain filling between the upper shell and the lower shell of the bag.

FIG. 6.1 is the top view of yet another configuration of this invention. The configuration has a cross concavity [110] in the middle of the pillow. The concavity [110] is surrounded by a plateau [111]. This configuration provides neck support like the configuration shown in FIG. 5. When the pillow is in use, the height difference between the bottom of the concavity and plateau is more than that of the configuration shown in FIG. 5. It also provides more room for one to turn his head in the concavity [110]. Likewise, to have a firmer neck support, a block [112] of firmer material, like foam rubber or a small air bag with higher air pressure, may be used for the filling in the portion of the plateau [111] at each end of the concavity [110]. It is obvious that the cross concavity [110] can be replaced by a concavity of ellipse, rectangle, heart, star, butterfly, letter, or other pattern. In the market, there are small circular concavities on a pillow/cushion for sofa/chair. They are more for ornament purposes. They can not be used for height choices or neck support of a sleeping pillow.

FIG. 6.2 is the 5—5 cross section view of the configuration shown in FIG. 6.1.

FIG. 6.3 is the 6—6 cross section view of the configuration shown in FIG. 6.1.

FIG. 7.1 is the top view of yet still another configuration of this invention. This configuration has two side-by-side connected small pillows [114]. The connection is made through one or more connectors [115] secured to the pillows [114]. Each of the connectors [115] is flat and flexible, like VELCRO, and can make the distance between the pillows [114] easily adjustable by user. The use of connectors [115] can serve the purpose of the configuration shown in FIG. 2.1 with more flexibility. The connectors can (not shown) also allow the user to overlap a corner of one of the two pillows [114] with the adjacent corner of the other pillow [114] such that the overlapped corners become a neck support. The height of the neck support depends on the amount of the overlap and is easily adjustable by the user.

FIG. 7.2 is the front view of the configuration shown in FIG. 7.1.

Although this invention has been described with a certain degree of particularity, it is to be understood that the present disclosure has been made by way of example only and that numerous changes in the detailed construction may be resorted to without departing from the spirit and scope of the invention as hereinafter claimed.

We claim:

1. A sleeping pillow having a generally rectangular sealed bag with loose filling, a pair of opposed longitudinal edges, and a pair of opposed side edges; said bag comprising an upper shell and a lower shell joined along their respective peripheries by an outer seam, and at least one lateral valley running through a portion of the width in the middle portion on at least one side of the pillow wherein at least one end of the at least one valley ends at a substantial distance from its adjacent longitudinal edge, at least one bottom of the at least one valley being formed by connecting a middle portion of the upper shell generally parallel to and spaced from the opposed side edges and the corresponding portion of the lower shell along at least one inner seam, the contour of the at least one bottom generally defined by the at least one inner seam having an elongated configuration of which the width may vary along the length and the length is at least twice the widest width.

2. A sleeping pillow having a generally rectangular sealed bag with loose filling, a pair of opposed longitudinal edges, and a pair of opposed side edges; said bag comprising an upper shell and a lower shell joined along their respective peripheries by an outer seam, and at least one lateral valley running through a portion of the width in the middle portion on at least one side of the pillow wherein at least one end of the at least one valley ends at a substantial distance from its adjacent longitudinal edge, a lump of soft material being located at least at one end of the at least one valley, at least one bottom of the at least one valley being formed by connecting a middle portion of the upper shell generally parallel to and spaced from the opposed side edges and the corresponding portion of the lower shell along at least one inner seam, the contour of the at least one bottom generally defined by the at least one inner seam having an elongated configuration of which the width may vary along the length and the length is at least twice the widest width.

3. A sleeping pillow according to claim 1, whereas one longitudinal valley intersects at least one middle portion of the at least one lateral valley at least on one side of the pillow wherein the bottom of the longitudinal valley being formed by connecting a middle portion of the upper shell generally parallel to and spaced from the opposed longitudinal edges and the corresponding portion of the lower shell along at least one inner seam, the contour of the bottom generally defined by the at least one inner seam having an elongated configuration of which the width may vary along the length and the length is at least twice the widest width.

4. A sleeping pillow according to claim 2, whereas one longitudinal valley intersects at least one middle portion of the at least one lateral valley at least on one side of the pillow wherein the bottom of the longitudinal valley being formed by connecting a middle portion of the upper shell generally parallel to and spaced from the opposed longitudinal edges and the corresponding portion of the lower shell along at least one inner seam, the contour of the bottom generally defined by the at least one inner seam having an elongated configuration of which the width may vary along the length and the length is at least twice the widest width.

* * * * *